US008882212B2

(12) United States Patent
Otobe

(10) Patent No.: US 8,882,212 B2
(45) Date of Patent: Nov. 11, 2014

(54) LIQUID EJECTION APPARATUS AND LIQUID CARTRIDGES

(75) Inventor: Mutsumi Otobe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 85 days.

(21) Appl. No.: 13/433,519

(22) Filed: Mar. 29, 2012

(65) Prior Publication Data

US 2013/0083097 A1 Apr. 4, 2013

(30) Foreign Application Priority Data

Sep. 30, 2011 (JP) ..... 2011-216674

(51) Int. Cl.
*B41J 29/38* (2006.01)
*B41J 2/175* (2006.01)

(52) U.S. Cl.
CPC ..... *B41J 29/38* (2013.01); *B41J 2/17533* (2013.01); *B41J 2/17546* (2013.01); *B41J 2/17523* (2013.01); *B41J 2/17513* (2013.01)
USPC ..... 347/5

(58) Field of Classification Search
CPC ..... B41J 29/38
USPC ..... 347/5
See application file for complete search history.

(56) References Cited

U.S. PATENT DOCUMENTS

| | | | | |
|---|---|---|---|---|
| 6,547,363 | B1 | 4/2003 | Shinada et al. | |
| 2003/0137568 | A1 | 7/2003 | Shinada et al. | |
| 2006/0227161 | A1 * | 10/2006 | Otsuki | 347/19 |
| 2009/0262171 | A1 | 10/2009 | Yamashita | |
| 2010/0225716 | A1 * | 9/2010 | Hayakawa et al. | 347/86 |

FOREIGN PATENT DOCUMENTS

| | | | |
|---|---|---|---|
| JP | 2006-035867 | A | 2/2006 |
| JP | 2008-307871 | A | 12/2008 |

* cited by examiner

*Primary Examiner* — Alessandro Amari
*Assistant Examiner* — Alexander C Witkowski
(74) *Attorney, Agent, or Firm* — Baker Botts L.L.P.

(57) ABSTRACT

A liquid ejection apparatus includes a liquid ejection head that ejects liquid, a hollow needle that communicates with the liquid ejection head, a moving mechanism that moves the hollow needle or a liquid cartridge such that the hollow needle penetrates a sealing member of the liquid cartridge, a reader that reads a data stored in a memory, and a controller that controls a speed of the hollow needle relative to the sealing member based on the data read by the reader.

14 Claims, 10 Drawing Sheets

LIQUID EJECTION APPARATUS AND LIQUID CARTRIDGES

CROSS REFERENCE TO RELATED APPLICATION

This application claims priority to Japanese Patent Application No. 2011-216674, filed Sep. 30, 2011, which is incorporated herein by reference.

BACKGROUND OF THE INVENTION

1. Field of the Invention

The invention relates generally to liquid ejection apparatus and liquid cartridges.

2. Description of Related Art

A known liquid ejection apparatus includes a liquid ejection head configured to eject liquid, a hollow needle configured to communicate with the liquid ejection head, and a moving mechanism configured to move the hollow needle, such that the hollow needle penetrates a sealing member of a liquid cartridge.

SUMMARY OF THE INVENTION

Nevertheless, the liquid may leak from the liquid cartridge when the hollow needle of the known liquid ejection apparatus penetrates or separates from the sealing member at an increased speed. Therefore, a need has arisen for a liquid ejection apparatus which overcomes this shortcoming.

According to an embodiment of the invention, a liquid ejection apparatus, to which a liquid cartridge is detachably attached, the liquid cartridge comprising: a liquid storing portion configured to store liquid; a communication portion having an opening, which communicates an interior of the liquid storing portion with an exterior of the liquid storing portion; and a sealing member configured to seal the opening of the communication portion, the liquid ejection apparatus comprising: a liquid ejection head configured to eject liquid; a hollow needle configured to communicate with the liquid ejection head; and a moving mechanism configured to move at least one of the hollow needle and the liquid cartridge, such that the hollow needle penetrates the sealing member of the liquid cartridge, wherein the liquid cartridge further comprises a particular memory configured to store particular data for determining a speed of the hollow needle relative to the sealing member when the moving mechanism moves the at least one of the hollow needle and the liquid cartridge to penetrate the sealing member of the liquid cartridge with the hollow needle, wherein the liquid ejection apparatus further comprises: a reader configured to read the particular data stored in the particular memory; and a controller configured to control a speed of the hollow needle relative to the sealing member when the moving mechanism moves the at least one of the hollow needle and the liquid cartridge to penetrate the sealing member of the liquid cartridge with the hollow needle based on the particular data read by the reader.

According to another embodiment of the invention, a liquid ejection apparatus, to which a liquid cartridge is detachably attached, the liquid cartridge comprising: a liquid storing portion configured to store liquid; a communication portion having an opening, which communicates an interior of the liquid storing portion with an exterior of the liquid storing portion; and a sealing member configured to seal the opening of the communication portion, the liquid ejection apparatus comprising: a liquid ejection head configured to eject liquid; a hollow needle configured to communicate with the liquid ejection head; and a moving mechanism configured to move at least one of the hollow needle and the liquid cartridge, such that the hollow needle selectively penetrates and withdraws from the sealing member of the liquid cartridge, wherein the liquid cartridge further comprises a particular memory configured to store further data for determining a speed of the hollow needle relative to the sealing member when the moving mechanism moves the at least one of the hollow needle and the liquid cartridge to withdraw the hollow needle from the sealing member of the cartridge, wherein the liquid ejection apparatus further comprises: a reader configured to read the further data stored in the particular memory; and a controller configured to control a speed of the hollow needle relative to the sealing member when the moving mechanism moves the at least one of the hollow needle and the liquid cartridge to withdraw the hollow needle from the sealing member of the liquid cartridge based on the further data read by the reader.

According to still another embodiment of the invention, a liquid ejection apparatus, to which a liquid cartridge is detachably attached, the liquid cartridge comprising: a liquid storing portion configured to store liquid; a communication portion having an opening, which communicates an interior of the liquid storing portion with an exterior of the liquid storing portion; and a sealing member configured to seal the opening of the communication portion, the liquid ejection apparatus comprising: a liquid ejection head configured to eject liquid; a hollow needle configured to communicate with the liquid ejection head; a moving mechanism configured to move at least one of the hollow needle and the liquid cartridge, such that the hollow needle penetrates the sealing member of the liquid cartridge; a particular memory configured to store particular data for determining a speed of the hollow needle relative to the sealing member when the moving mechanism moves the at least one of the hollow needle and the liquid cartridge to penetrate the sealing member of the liquid cartridge with the hollow needle; a reader configured to read the particular data stored in the particular memory; and a controller configured to control a speed of the hollow needle relative to the sealing member when the moving mechanism moves the at least one of the hollow needle and the liquid cartridge to penetrate the sealing member of the liquid cartridge with the hollow needle based on the particular data read by the reader.

According to yet another embodiment of the invention, a liquid cartridge comprising: a liquid storing portion configured to store liquid; a communication portion having an opening, which communicates an interior of the liquid storing portion with an exterior of the liquid storing portion; a sealing member configured to seal the opening of the communication portion and to be selectively penetrated and closed; and a particular memory configured to store at least one of particular data for determining a speed at which the sealing member is penetrated and further data for determining a speed at which the sealing member is closed.

Other objects, features, and advantages of an embodiment of the invention will be apparent to persons of ordinary skill in the art from the following description of an embodiment with reference to the accompanying drawings.

BRIEF DESCRIPTION OF THE DRAWINGS

For a more complete understanding of the present invention, needs satisfied thereby, and the objects features, and advantages thereof, reference now is made to the following descriptions taken in connection with the accompanying drawings.

DETAILED DESCRIPTION OF EMBODIMENTS OF THE INVENTION

Figure 1:
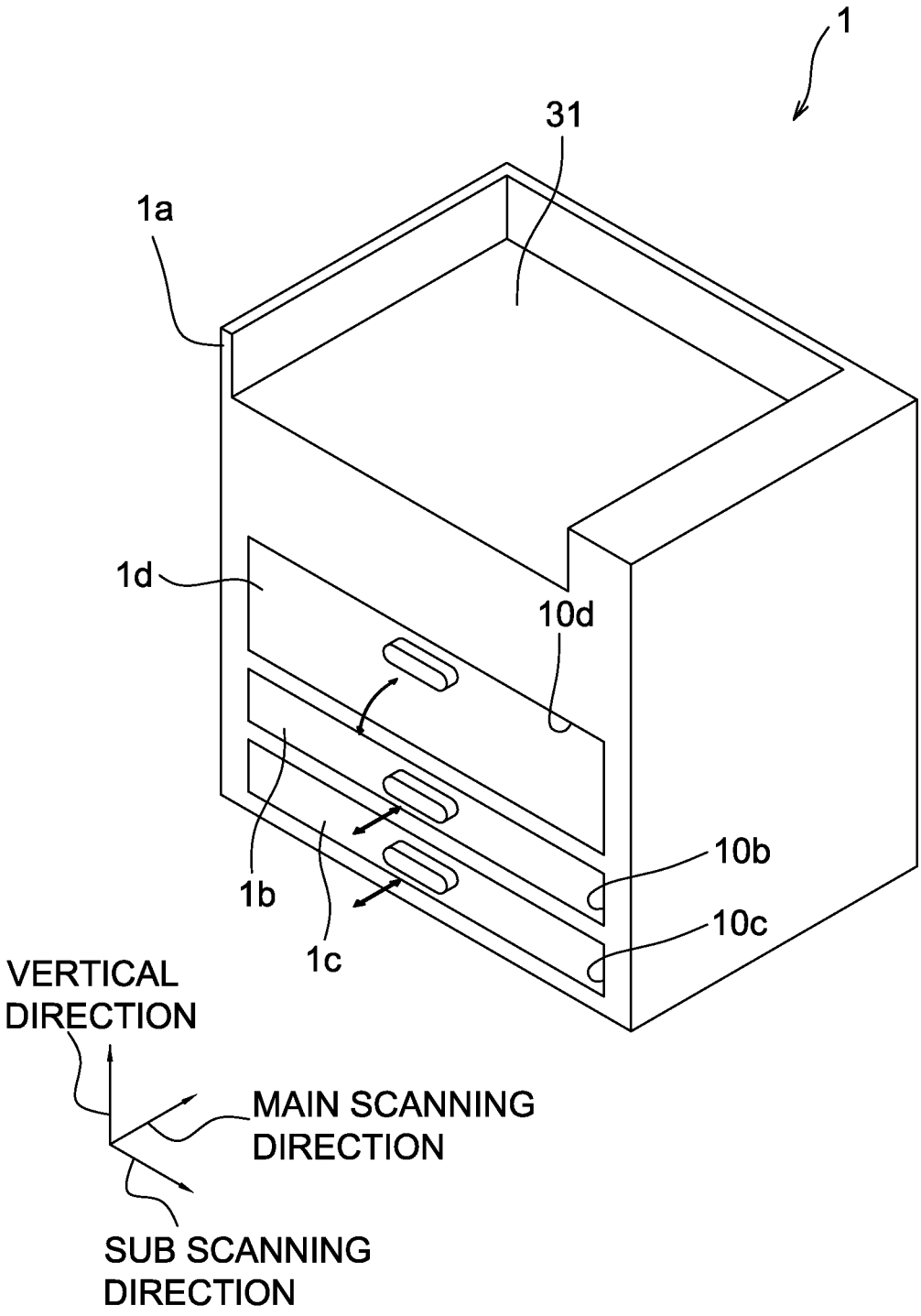
FIG. 1 is an external perspective view depicting a liquid ejection apparatus according to an embodiment of the invention.

Embodiments of the invention now are described in detail with reference to the accompanying drawings; like reference numerals are used for corresponding parts in the various drawings.

Referring to FIG. 1, an inkjet printer 1, e.g., a liquid ejection apparatus, may comprise a housing 1*a* having a substantially rectangular-parallelepiped shape. A sheet output portion 31 may be disposed on a top plate of the housing 1*a*. A front surface, e.g., a surface at the left front of the sheet surface of FIG. 1, of the housing 1*a* may have three openings 10*d*, 10*b*, and 10*c* in order from the upper side. The opening 10*b* may allow a sheet feed unit 1*b* to be inserted into the housing 1*a*, and the opening 10*c* may allow an ink unit 1*c* to be inserted into the housing 1*a*. A door 1*d* may be fitted to the opening 10*d*, such that the door 1*d* may be supported by a horizontal shaft to selectively open and close. The door 1*d* may be arranged to face a conveying unit 21, as depicted FIG. 2, in a main-scanning direction of the housing 1*a*, e.g., a direction orthogonal to the front surface of the housing 1*a*.

Figure 2:
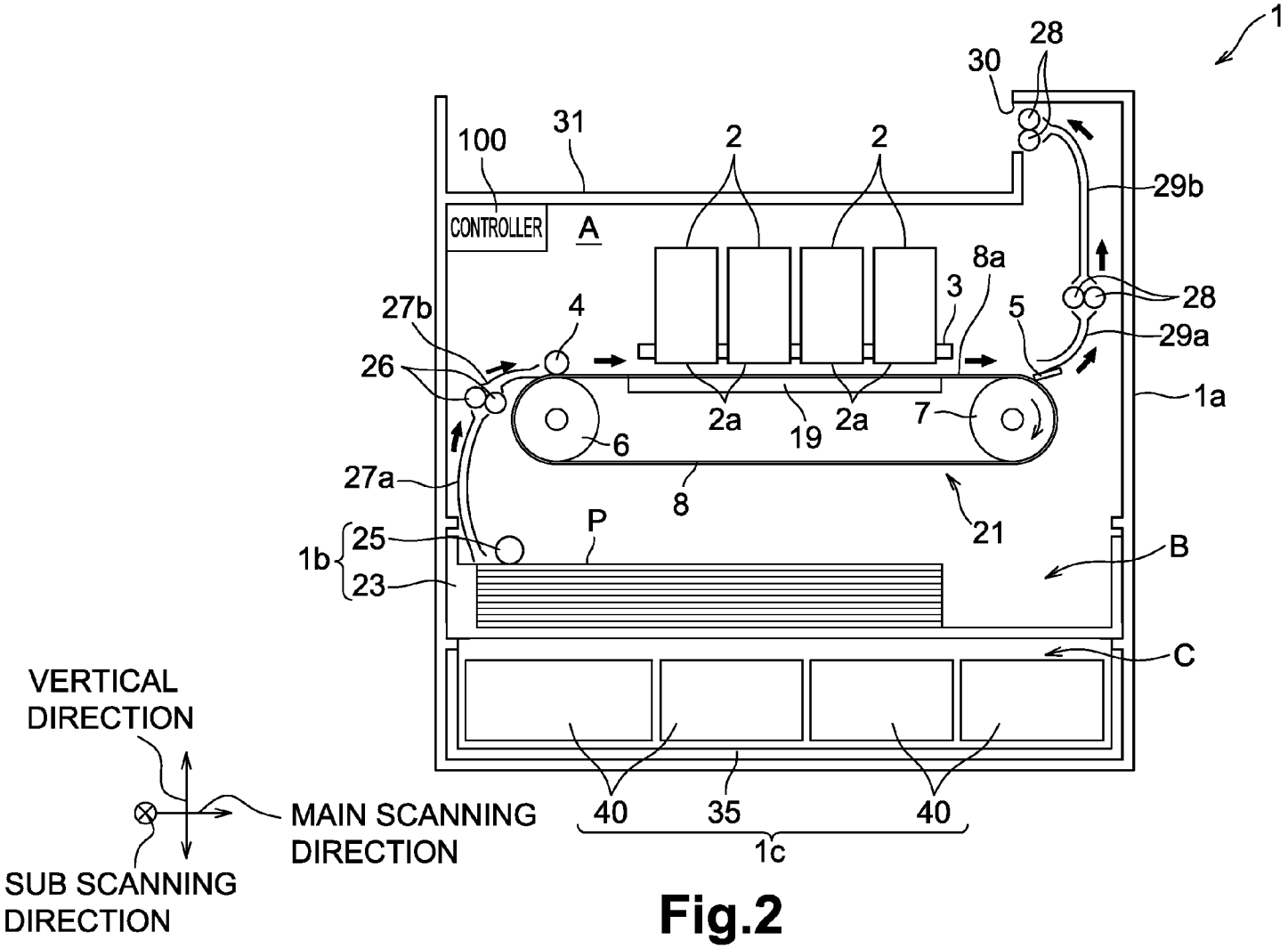
FIG. 2 is a cross-sectional view depicting an interior of a printer according to an embodiment of the invention.

Referring to FIG. 2, the inner space of the housing 1*a* may be divided into spaces A, B, and C in order from the upper side. Four inkjet heads 2 that eject inks of magenta, cyan, yellow, and black color, respectively; the conveying unit 21 that conveys a sheet P; and a controller 100 that controls operations of respective units of the printer 1 may be arranged in the space A. The sheet feed unit 1*b* may be arranged in the space B, and the ink unit 1*c* may be arranged in the space C. A sheet conveying path, through which a sheet P may be conveyed, may be formed in the printer 1 and may extend from the sheet feed unit 1*b* to the sheet output portion 31 along black arrows, as depicted in FIG. 2.

The controller 100 may comprise, for example, a central processing unit (CPU) serving as an arithmetic processing unit, a read only memory (ROM), a random access memory (RAM) comprising a nonvolatile RAM, and an interface (I/F). The ROM may store a program executed by the CPU, various fixed data, and other variable data. The RAM temporarily may store data required when the program is executed. The controller 100 may receive data from a memory 141 of a cartridge 40, transmit and receive data to and from a sensor unit 70 of the cartridge 40, and transmit and receive data to and from an external device, e.g., a personal computer (PC) connected with the printer 1, through the I/F.

The sheet feed unit 1*b* may comprise a sheet feed tray 23 and a sheet feed roller 25. The sheet feed tray 23 may be removably attached to the housing 1*a* in the main-scanning direction. The sheet feed tray 23 may be a box with an opening at the upper side, and may store sheets P of different sizes. The sheet feed roller 25 may rotate when driven by a sheet feed motor 125, as depicted FIG. 8, and may feed a sheet P stored in the sheet feed tray 23. The controller 100 may control the sheet feed roller 25 to rotate. The sheet P may be fed by the sheet feed roller 25 to the conveying unit 21 while the sheet P is guided by guides 27*a* and 27*b* and pinched between a roller pair 26.

The conveying unit 21 may comprise two belt rollers 6 and 7, and an endless conveying belt 8 wound around the rollers 6 and 7 and extending between the rollers 6 and 7. The belt roller 7 may be a driving roller that rotates clockwise in FIG. 2 when driven by a convey motor 127, as depicted FIG. 8, which may be connected with the shaft of the belt roller 7. The controller 100 may control the driving roller to rotate. The belt roller 6 may be a driven roller that rotates clockwise in FIG. 2 when the conveying belt 8 moves by the rotation of the belt roller 7.

A platen 19 with a substantially rectangular-parallelepiped shape may be arranged in the loop of the conveying belt 8 to face the four heads 2. The upper loop section of the conveying belt 8 may be supported by the platen 19 from the side of an inner peripheral surface, so that an outer peripheral surface 8*a* of the conveying belt 8 extends in parallel to lower surfaces 2*a*, e.g., ejection surfaces having ejection ports that eject the inks, of the four heads 2 while the outer peripheral surface 8*a* may be separated from the lower surfaces 2*a* by a predetermined distance.

A silicon layer with a low adhesiveness may be formed on the outer peripheral surface 8*a* of the conveying belt 8. The sheet P fed from the sheet feed unit 1*b* to the conveying unit 21 may be pressed on the outer peripheral surface 8*a* of the conveying belt 8 by a pressure roller 4, and may then be conveyed in a sub-scanning direction along the black arrows while the sheet S is held on the outer peripheral surface 8*a* due to the adhesiveness.

The sub-scanning direction may be a direction parallel to a conveying direction of the sheet P conveyed by the conveying unit 21. The main-scanning direction may be a direction orthogonal to the sub-scanning direction and parallel to a horizontal plane.

When the sheet P passes through an area directly below the four heads 2, the heads 2 may be driven by the controller 100, and the inks of the respective colors may be ejected successively from the lower surfaces 2*a* of the heads 2 to the upper surface of the sheet P. Accordingly, a color image may be formed on the sheet P. The sheet P then may be separated from the outer peripheral surface 8*a* of the conveying belt 8 by a separation plate 5, conveyed upward while the sheet P is guided by guides 29*a* and 29*b* and pinched by two feed roller pairs 28, and output to the sheet output portion 31 through an opening 130 formed at an upper section of the housing 1*a*. The controller 100 may control a feed motor 128 to drive one roller of each of the feed roller pairs 28 to rotates, as depicted FIG. 8.

The heads 2 may be line heads that extend in the main scanning direction, e.g., a direction orthogonal to the sheet surface of FIG. 1, and each may have a substantially rectangular-parallelepiped outer shape. The length of the outer shape may be aligned in the main scanning direction. The four heads 2 may be arranged at a predetermined pitch in the sub-scanning direction, and supported at the housing 1*a* through a frame 3. Each of the heads 2 may have a junction on an upper surface, many ejection ports at the lower surface 2*a*, and an ink flow path in the head 2. A flexible tube may be attached to the junction. Through the ink flow path, the ink fed from the corresponding ink cartridge 40 via the tube and the junction may flow to the ejection ports.

The ink unit 1*c* may comprise a cartridge tray 35 and the four ink cartridges 40 arranged side by side in the tray 35. The leftmost cartridge 40 in FIG. 2 may store the black ink, and may have a greater width in the sub-scanning direction and a larger ink capacity than those of the remaining three cartridges 40. The remaining three cartridges 40 may store the magenta ink, the cyan ink, and the yellow ink, respectively, and may have substantially the same size in the sub-scanning direction and the substantially same ink capacity. The inks stored in the cartridges 40 may be fed to the corresponding heads 2 through the tubes and the junctions.

The tray 35 may be removably attachable on the housing 1*a* in the main-scanning direction when the cartridges 40 are arranged in the tray 35. One or more of the four cartridges 40 in the tray 35 may be replaced when the tray 35 is removed from the housing 1*a*.

The four cartridges 40 arranged in the tray 35 may have similar configurations, except that the cartridge of the black ink may have a greater width in the sub-scanning direction and a greater ink capacity than those of the cartridges of the other colors.

Referring to FIGS. 3-6, the cartridge 40 may comprise a case 41, a reservoir 42, a feed pipe 43, a sealing member 50, a valve 60, the sensor unit 70, the memory 141, a contact 142, and a power input portion 147.

Figure 3:
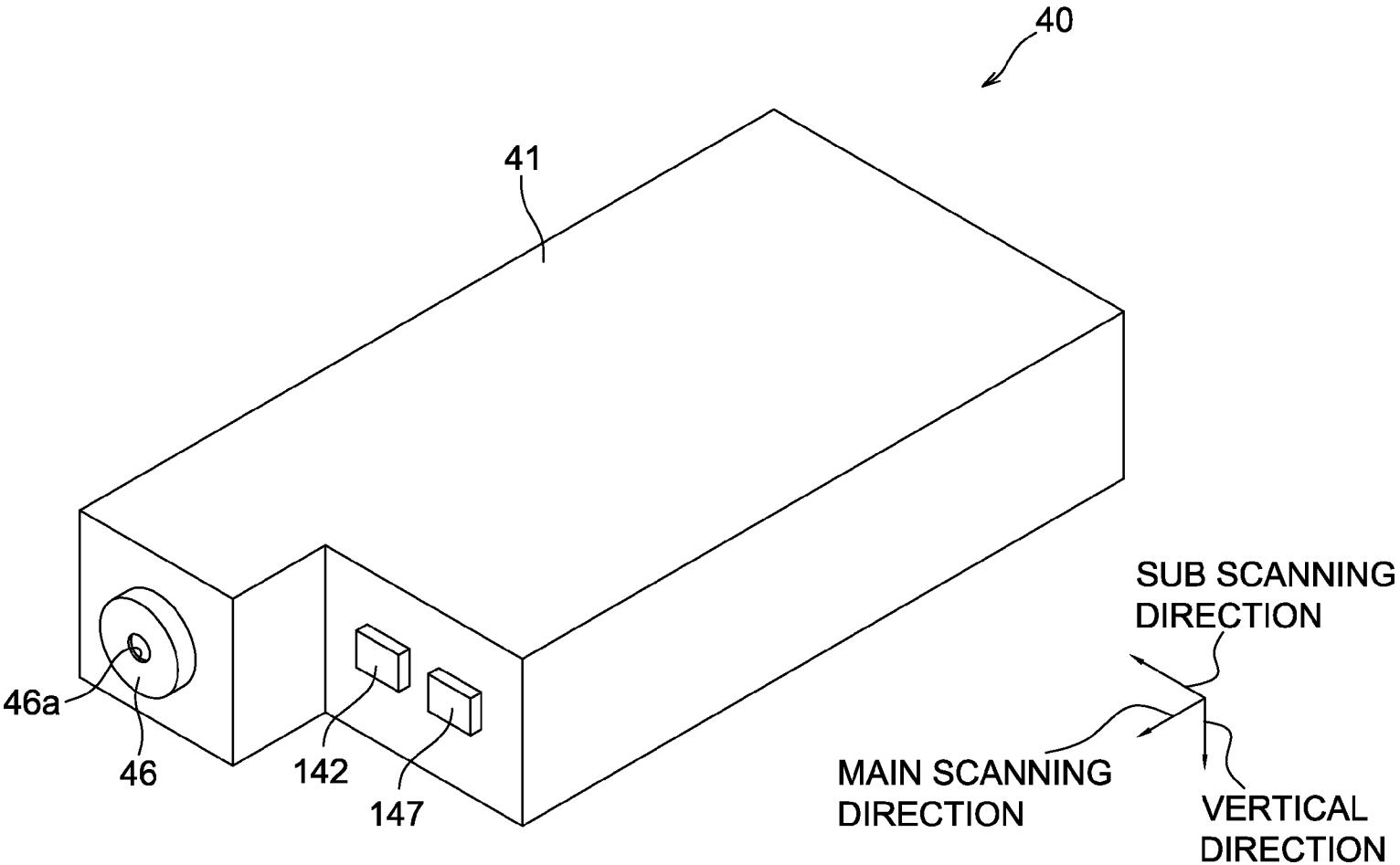
FIG. 3 is a perspective view depicting a liquid cartridge according to according to an embodiment of the invention.
Figure 4:
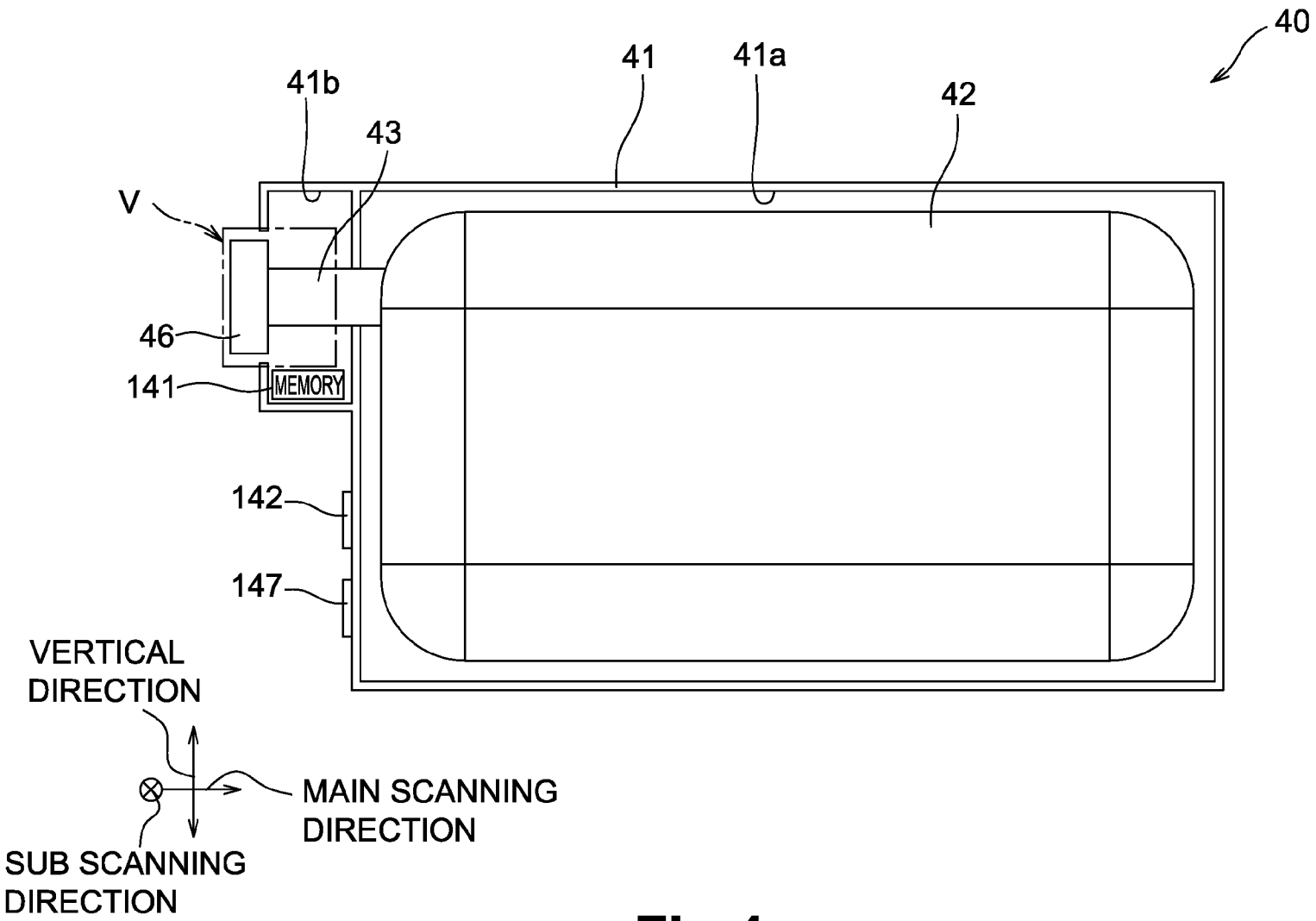
FIG. 4 is a block diagram depicting an interior of a liquid cartridge.

The case 41 may have a substantially rectangular-parallelepiped shape, as depicted in FIG. 3. Referring to FIG. 4, the interior of the case 41 may be divided into two chambers 41*a* and 41*b*. The reservoir 42 may be arranged in the right chamber 41*a*, and the feed pipe 43 may be arranged in the other chamber 41*b*.

The reservoir 42 may comprise a bag that stores an ink and may be arranged in the case 41. A proximal end of the feed pipe 43 may be connected to an opening of the reservoir 42.

The feed pipe 43 may define a feed path 43*a* for feeding the ink stored in the reservoir 42 to the head 2.

Referring to FIG. 4, a distal end of the feed pipe 43 may protrude to an exterior of the case 41. A sealing member 50 comprising an elastic material, e.g., rubber, may be disposed at the distal end of the feed pipe 43 in a compressed state to cover an opening 43*b* formed at a position opposite to the reservoir 42 of the feed path 43*a*, as depicted FIGS. 5A and 5B. A cap 46 may be disposed at the distal end of the feed pipe 43 and at the exterior of the sealing member 50. The cap 46 may have an opening 46*a* at its center, and a front surface, e.g., a surface opposite to a back surface that faces the valve 60, of the sealing member 50 may be exposed through the opening 46*a*.

Figure 5A:
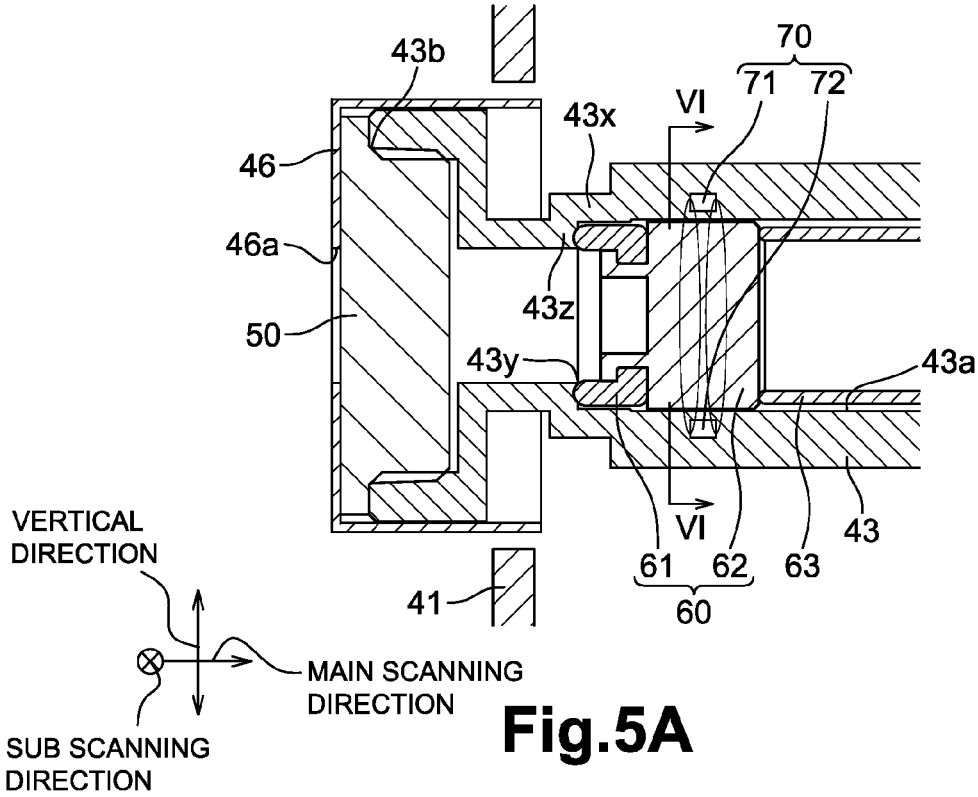
FIG. 5A is a cross-sectional view of a region V in FIG. 4 when a hollow needle of a printer does not penetrate a sealing member and a valve is at a closed position according to an embodiment of the invention.
Figure 5B:
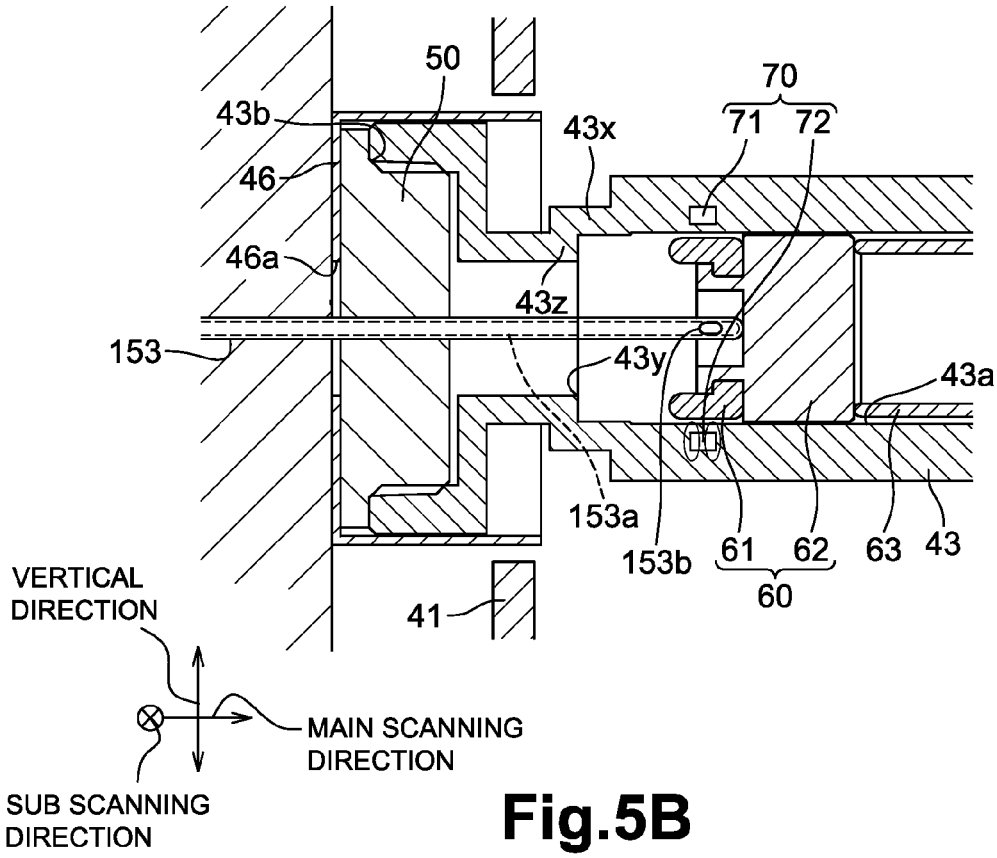
FIG. 5B is a cross-sectional view of the region V in FIG. 4 when the hollow needle of the printer penetrates the sealing member and the valve is at an open position according to an embodiment of the invention.

Referring to FIGS. 5A and 5B, the valve 60 may be arranged at the feed path 43*a*, and may comprise an O-ring 61 and a valve body 62.

Figure 6:
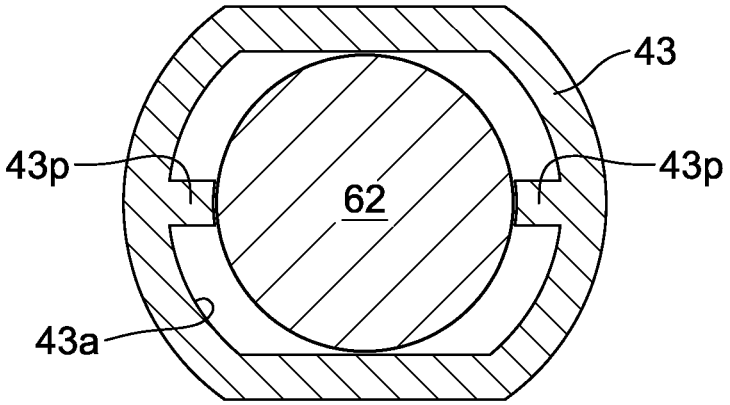
FIG. 6 is a cross-sectional view taken along line VI-VI in FIG. 5A according to an embodiment of the invention.

Referring to FIGS. 5A, 5B, and 6, the valve body 62 may comprise a cylindrical magnetic substance having an axis extending in the main-scanning direction.

Referring to FIG. 6, a portion of the feed pipe 43 arranged with the valve body 62 may have a cylindrical shape with flat upper and lower walls and a cross-section orthogonal to the main-scanning direction that extends in the sub-scanning direction. Protrusions 43*p* protruding to the inside along the sub-scanning direction may be formed on inner surfaces of side walls at both sides in the sub-scanning direction of the feed pipe 43. Each protrusion 43*p* may extend in the main-scanning direction in a movable range of the valve body 62. The valve body 62 may be pinched by the protrusions 43*p* and the upper and lower walls of the feed pipe 43, and may be positioned at the center of the feed path 43*a* in cross-sectional view. A flow path may be disposed between the valve body 62 and the feed pipe 43, in an area excluding contact portions of the valve body 62 with respect to the protrusions 43*p* and the upper and lower walls of the feed pipe 43.

The O-ring 61 may comprise an elastic material, e.g., rubber, and may be fixed to the front surface, e.g., a surface facing the sealing member 50, of the valve body 62.

The valve 60 may be urged to an opening 43*y* by a coil spring 63. One end of the coil spring 63 may be fixed to the proximal end of the feed pipe 43, and the other end of the coil spring 63 is in contact with the back surface of the valve body 62.

Referring to FIG. 5A, when the valve 60 is at the closed position, at which the valve 60 closes the feed path 43*a*, the O-ring 61 may contact a portion, e.g., a valve seat, 43*z* that protrudes from one end, e.g., an end near the opening 43*b*, of a small-diameter portion 43*x* of the feed pipe 43 toward the center in the radial direction of the feed pipe 43, so that the O-ring 61 may seal the opening 43*y* at the one end of the small-diameter portion 43*x*. Accordingly, the communication between the interior of the reservoir 42 and the exterior of the case 41 through the opening 43*b* may be interrupted. The O-ring 61 may be deformed elastically by the urging force of the coil spring 63.

The sensor unit 70 may comprise a Hall element 71 and a magnet 72. The magnet 72 may generate a magnetic field. The Hall element 71 may be a magnetic sensor that converts an input magnetic field into an electric signal and outputs the electric signal to the controller 100 through the contact 142. The Hall element 71 may output a signal indicating to the controller 100 a voltage value that is proportional to the magnitude of the magnetic field that varies in accordance with the movement of the valve body 62.

The Hall element 71 may be arranged at a position at which a magnetic field from the magnet 72 and the valve body 62 may be detected by the Hall element 71, as depicted FIG. 5A.

Referring to FIG. 5A, the Hall element 71 and the magnet 72 may be fixed to the upper and lower walls of the feed pipe 43, respectively, and may face each other in the vertical direction.

When the valve 60 is located at the closed position as depicted in FIG. 5A, the Hall element 71 and the magnet 72 may face each other with the valve body 62 interposed therebetween, e.g., the valve body 62 may be positioned between the Hall element 71 and the magnet 72. The magnetic field generated by the magnet 72 may efficiently reach the Hall element 71 through the valve body 62. Thus, the magnetic field detected by the Hall element 71 may be substantially great, and the Hall element 71 may output a signal indicating a HIGH voltage value.

When the valve 60 is moved from the closed position, as depicted in FIG. 5A, to the open position, at which the feed path 43*a* is opened, as depicted in FIG. 5B, the valve body 62 may move to a position at which the Hall element 71 may not face the magnet 72 in the vertical direction, e.g., a position not between the Hall element 71 and the magnet 72. Accordingly, the magnetic field detected by the Hall element 71 may decrease, and the voltage value indicated by the signal output from the Hall element 71 may decrease.

The controller 100 may determine whether the valve 60 is at the open position or the closed position based on the voltage value indicated by the signal received from the Hall element 71.

The memory 141 may be an electrically erasable programmable ROM (EEPROM) and may store data.

Figure 7A:
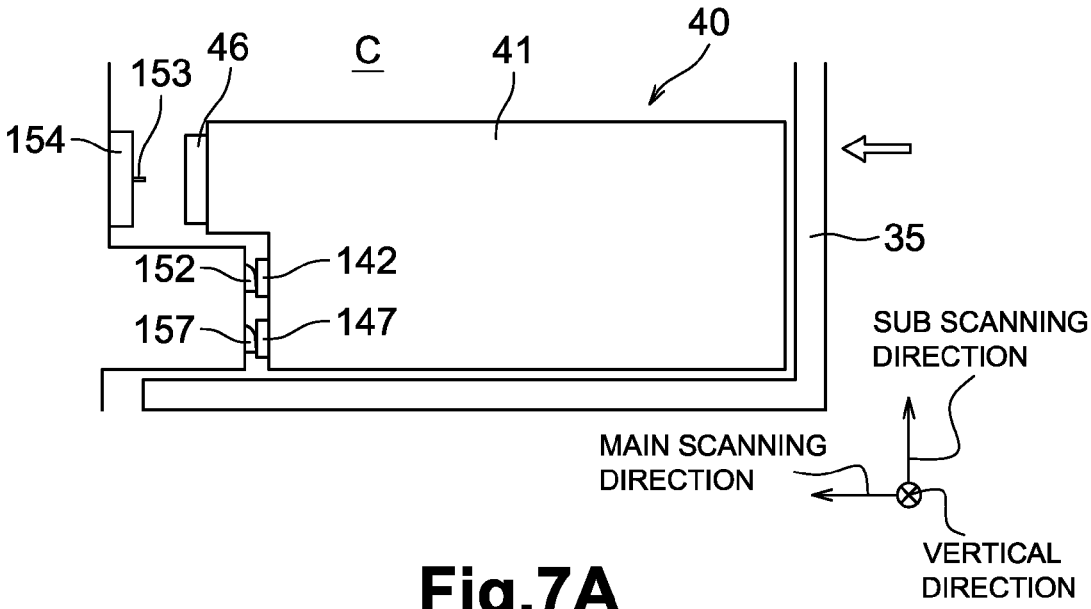
FIG. 7A is a plan view depicting a step of a process for mounting a cartridge on a printer according to an embodiment of the invention.
Figure 7B:
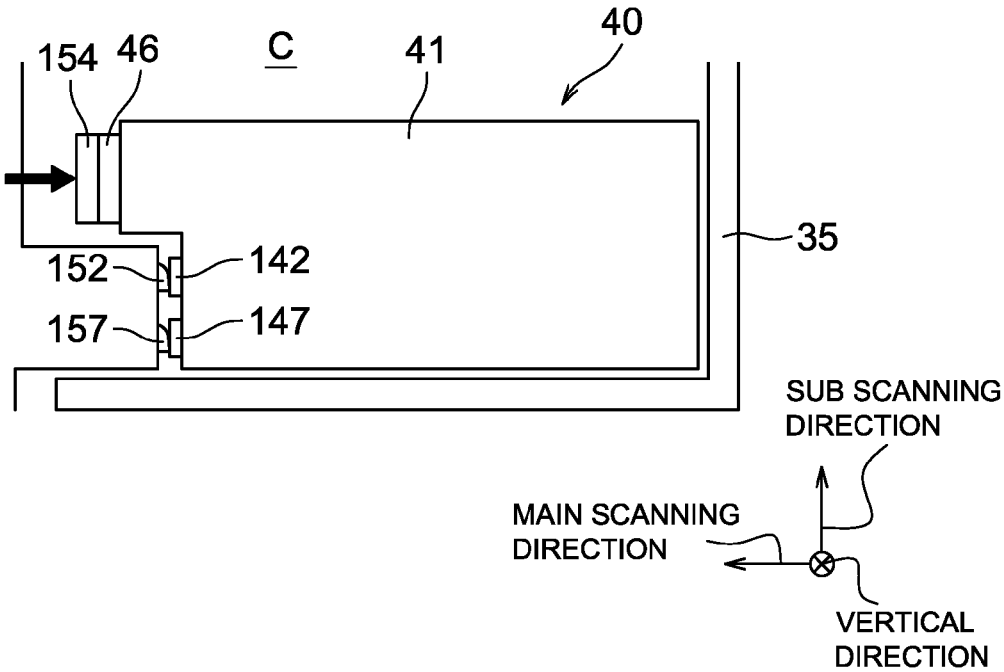
FIG. 7B is another plan view depicting the process for mounting a cartridge on a printer according to an embodiment of the invention.
Figure 8:
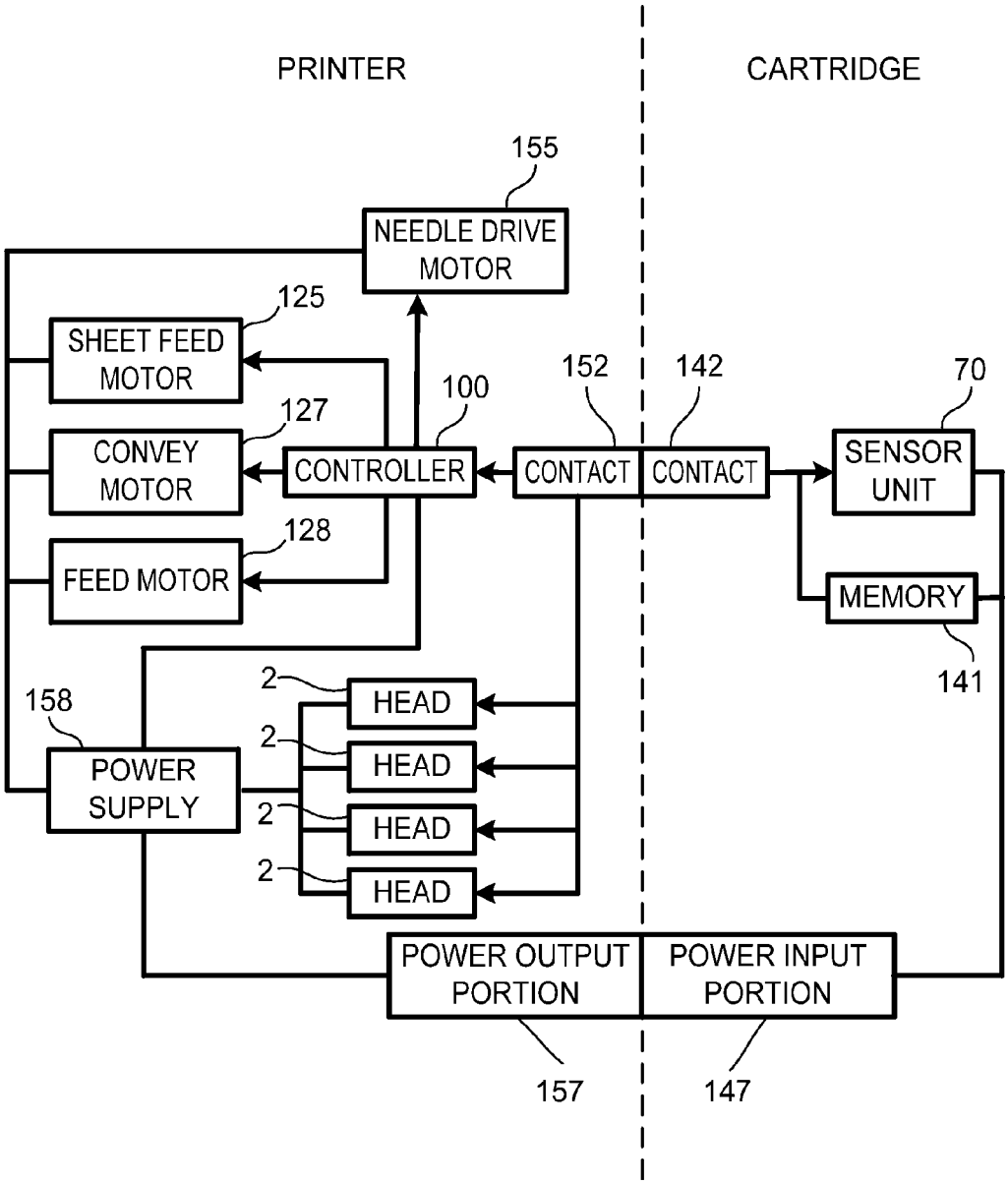
FIG. 8 is a diagram depicting electrical configurations of a cartridge and a printer according to an embodiment of the invention.

Referring to FIGS. 5A-10, a process may be performed for mounting the cartridge 40 on the printer 1. FIG. 8 depicts power feed lines by thick lines and depicts signal lines by thin lines.

When the cartridge 40 is not attached on the printer 1, as depicted in FIG. 5A, a hollow needle 153 may not penetrate the sealing member 50, and the valve 60 may be held at the closed position. Electric connection between the contact 142 and a contact 152 and electric connection between the power input portion 147 and a power output portion 157, as depicted in FIG. 8, may not be connected. Thus, transmission and reception of signals between the cartridge 40 and the printer 1 may not be available, and electric power may not be fed to the sensor unit 70 or the memory 141.

When the cartridge 40 is attached on the printer 1, in a state in which the cartridge 40 is arranged in the tray 35, as depicted FIG. 2, the tray 35 may be moved in the main-scanning direction, e.g., a direction indicated by a white arrow in FIG. 7A, and may be inserted into the space C of the housing 1*a*. As depicted in FIG. 7A, the contact 142 of the cartridge 40 may contact the contact 152 of the printer 1, so that the cartridge 40 may be electrically connected with the printer 1. Accordingly, transmission and reception of signals between the cartridge 40 and the printer 1 may be implemented. The contact 152 may function as the I/F of the controller 100, and may be formed at a wall surface that defines the space C in the housing 1*a*.

As depicted in FIG. 7A, the power input portion 147 of the cartridge 40 and the power output portion 157 of the printer 1 may contact each other and may be electrically connected with each other simultaneously when the contacts 142 and 152 contact each other. Accordingly, electric power may be fed from a power supply 158 to the sensor unit 70 and the memory 141 through the power output portion 157 and the power input portion 147, as depicted FIG. 8.

The power supply 158 may be disposed in the housing 1*a* and may feed electric power to the respective units of the printer 1. The power output portion 157 may be electrically connected with the power supply 158 and may be disposed at a position where the power output portion 157 faces the power input portion 147 of each cartridge 40 at the wall surface that defines the space C in the housing 1*a*, as depicted FIGS. 7A and 7B. The power input portion 147 may be electrically connected with the sensor unit 70 and the memory 141 and may be exposed to the outer surface of the case 41 in an area near the contact 142.

The cartridge 40 may be separated from the hollow needle 153, and the reservoir 42 may not communicate with the ink flow path of the head 2. The hollow needle 153 may be fixed to a support body 154 that may move in the main-scanning direction relative to the housing 1*a*, and the hollow needle 153 may communicate with the tube attached to the junction of the head 2. The hollow needle 153 and the contact 152 may be disposed to correspond to each of the cartridges 40. A needle drive motor 155, as depicted in FIG. 8, may be disposed to correspond to each of the cartridges 40.

When the needle drive motor 155 rotates forward in response to control signals of the controller 100, the support body 154 may move in a direction indicated by a black arrow in FIG. 7B, e.g., a penetrating direction, while the support body 154 may support the hollow needle 153. When the needle drive motor 155 rotates backward, the support body 154 may move in a direction opposite to the insertion direction, e.g., a removing direction, while the support body 154 may support the hollow needle 153.

Figure 9:
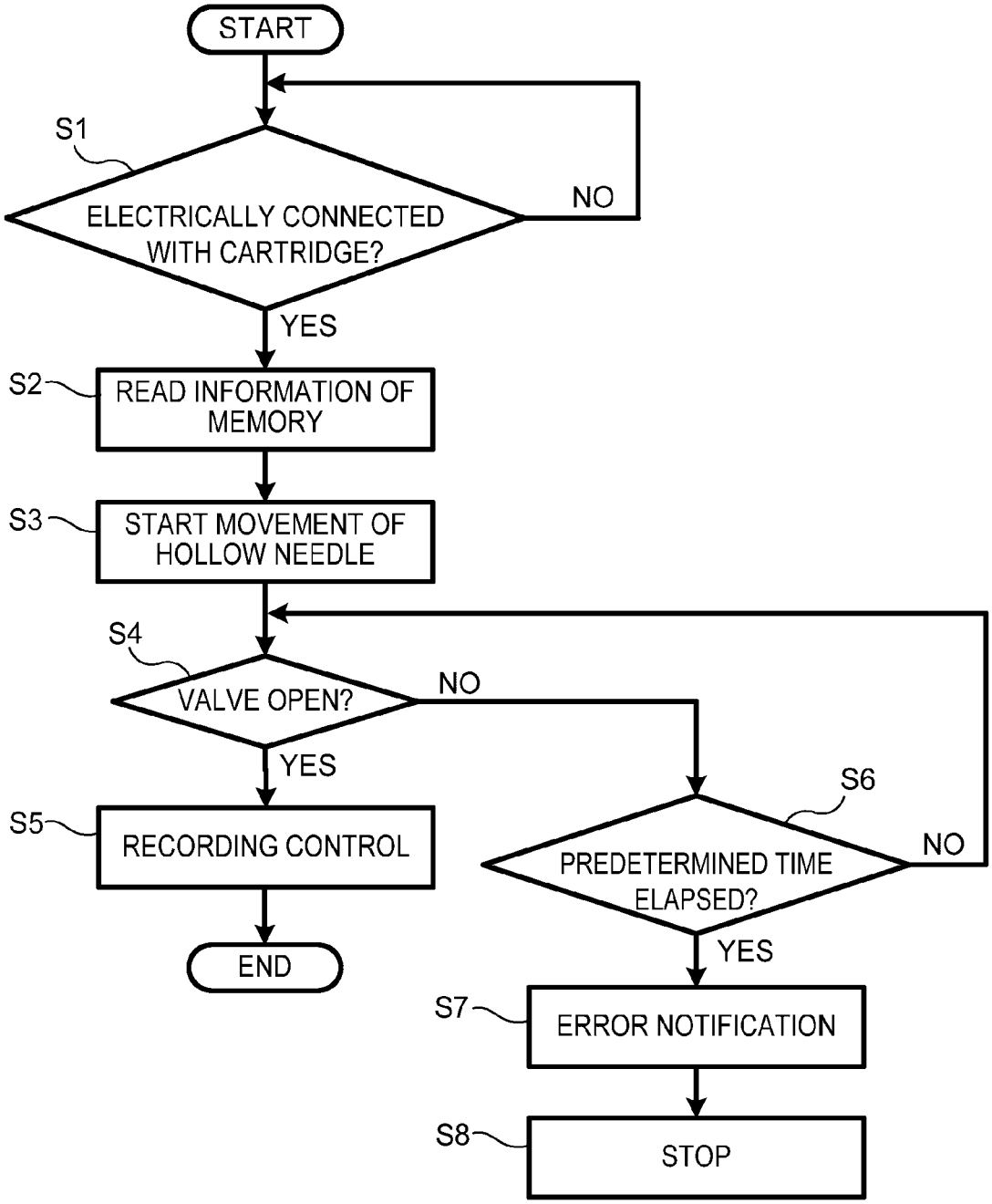
FIG. 9 is a flowchart depicting a process executed by a controller of a printer when a cartridge is attached on the printer according to an embodiment of the invention.

As depicted in FIG. 9, when the controller 100 detects the electric connection between the cartridge 40 and the printer 1, e.g., YES in step S1, the controller 100 may read data stored in the memory 141 of the cartridge 40 in step S2.

The memory 141 may store data for deriving the speed of the hollow needle 153 relative to the sealing member 50 when the hollow needle 153 penetrates the sealing member 50 and when the hollow needle 153 is removed from the sealing member 50. For example, the memory 141 may store the speed value and, as data for deriving the speed, data relating to the material of the sealing member 50, e.g., the name of the material; values of elasticity and brittleness depending on the material; data relating to the thickness of the sealing member 50 in a moving direction, e.g., the penetrating direction and removing direction, of the hollow needle 153 relative to the sealing member 50; data relating to the elapsed time since the sealing member 50 is manufactured; e.g., data including the year, date, and time when the sealing member 50 is manufactured, data relating to a period of time from when the sealing member 50 is manufactured to the current time, e.g., a time having a length on the date or year basis or the like; and data relating to the number of times the hollow needle 153 penetrates the sealing member 50.

The memory 141 may store such data whenever the hollow needle 153 penetrates the sealing member 50 and whenever the hollow needle 153 is removed from the sealing member 50. The data stored when the hollow needle 153 penetrates the sealing member 50 may be referred to as "penetrating data" and the data stored when the hollow needle 153 is removed from the sealing member 50, e.g., when the sealing member 50 is closed, may be referred to as "removing data."

After step S2, the controller 100 may control the current value or voltage value of the needle drive motor 155 based on the data read in step S2, e.g., the penetrating data, and may cause the needle drive motor 155 to rotate forward. Accordingly, the support body 154 and the hollow needle 153 may begin to move in the penetrating direction, e.g., a direction indicated by the black arrow in FIG. 7B, in step S3.

After the controller 100 causes the hollow needle 153 to begin moving in step S3, the controller 100 may determine whether the valve 60 is arranged at the open position based on the output value from the Hall element 71 in step S4.

When the hollow needle 153 starts moving in step S3, as depicted in FIG. 5B, the hollow needle 153 may penetrate substantially the center of the sealing member 50 through the opening 46*a* in the main-scanning direction.

At this time, an opening 153*b* disposed at the distal end of the hollow needle 153 may be established at the feed path 43*a*. Thus, a flow path 153*a* in the hollow needle 153 may communicate with the feed path 43*a* through the opening 153*b*. Further, a hole may be formed at the sealing member 50 by the hollow needle 153, and the periphery of the hole in the sealing member 50 may closely contact the outer peripheral surface of the hollow needle 153. Accordingly, the ink may be prevented from leaking through a gap between the hole of the sealing member 50 and the hollow needle 153.

The distal end of the hollow needle 153 then may contact the valve body 62. When the hollow needle 153 further advances into the feed path 43*a*, the valve body 62 may move together with the O-ring 61, and the O-ring 61 may be separated from the valve seat 43*z*, as depicted FIG. 5B. Thus, the valve 60 may move from the closed position to the open position.

When the valve 60 is at the open position, the inside of the reservoir 42 and the outside of the case 41 may be allowed to communicate with each other through the opening 43*b*. As depicted in FIG. 5B, when the hollow needle 153 penetrates the sealing member 50 and the valve 60 is at the open position, the reservoir 42 may communicate with the ink flow path of the head 2 through the feed path 43*a* and the flow path 153*a*.

Figure 10:
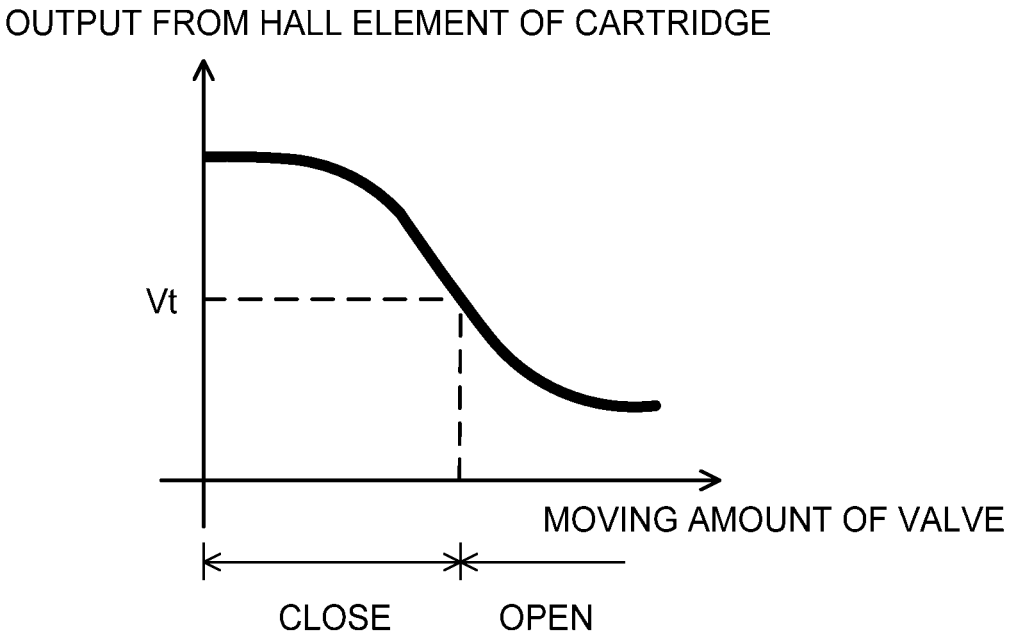
FIG. 10 is a graph depicting a relationship between a moving amount of a valve and an output value from a Hall element of a cartridge according to an embodiment of the invention.

FIG. 10 is a graph depicting the relationship between the moving amount of the valve 60 and the output value from the Hall element 71. The horizontal axis may represent the moving amount of the value 60 from the closed position, as depicted in FIG. 5A, in a direction in which the valve 60 is separated from the sealing member 50 in the main-scanning direction. The controller 100 may determine that the valve 60 may move from the closed position to the open position if the output value from the Hall element 71 reaches a threshold Vt.

When the valve 60 is at the open position, e.g., YES at step S4, the controller 100 may stop the rotation of the needle drive motor 155 and then may perform recording control in step S5. The routine then may terminate.

In the recording control in step S5, the controller 100 may perform processing in accordance with a recording instruction received from an external device, e.g., driving control of the sheet feed motor 125, the convey motor 127, the feed motor 128 as depicted FIG. 8, and the head 2.

If a predetermined time elapses while the valve 60 is not at the open position, e.g., YES at step S6, the controller 100 may perform error notification in step S7 by output means, such as a display or a speaker of the printer 1, and may stop the operations of the respective units in the printer 1 in step S8. Thus, there may be a defect in one or more of the sensor unit 70, the sealing member 50, and the valve 60 of the cartridge 40 and the hollow needle 153 and the needle drive motor 155 of the printer 1.

If the plurality of cartridges 40 are attached on the printer 1 simultaneously, the controller 100 may perform the series of processing, as depicted in FIG. 9, for each of the cartridges 40.

After the cartridge 40 is attached on the printer 1, the tray 35 may be locked in the housing 1*a* by a lock mechanism or the like, so that the tray 35 may not be removed from the space C.

When the cartridge 40 is removed from the printer 1, the lock may be released by pressing a lock release button. When the controller 100 receives a signal corresponding to the depression of the lock release button, the controller 100 may control the current value or voltage value of the needle drive motor 155 based on data, e.g., removing data, read in step S2 to rotate the needle drive motor 155 backward. Accordingly, the support body 154 and the hollow needle 153 may begin to move in the removing direction, e.g., a direction opposite to the direction indicated by the black arrow in FIG. 7B.

When the hollow needle 153 moves leftward in FIG. 5B, the valve 60 may move leftward in FIG. 5B and may contact the valve seat 43*z* by the urging force of the coil spring 63. Thus, the valve 60 may move from the open position to the closed position. The hollow needle 153 then may be removed from the sealing member 50. The size of the hole formed at the sealing member 50 by the hollow needle 153 may reduce by a certain degree, such that the ink may not leak because of the elasticity of the periphery of the hole. The hole of the sealing member 50 may be closed. Thus, the sealing member 50 may selectively open and close.

When the controller 100 detects that the hollow needle 153 reaches the initial position, as depicted in FIG. 7A, the controller 100 may stop the rotation of the needle drive motor 155 and may release the lock. Thus, the tray 35 may become removable.

When the tray 35 is removed from the housing la, the four cartridges 40 may separate simultaneously from the corresponding contacts 152 and the power output portions 157. Accordingly, both the electric connection between the contacts 142 and the contacts 152 and the electric connection between the power input portions 147 and the power output portions 157 may be disconnected. The transmission and reception of signals between the cartridge 40 and the printer 1 may become unavailable, and electric power may no longer be fed to the sensor unit 70 or the memory 141.

The controller 100 may reference a table stored in the ROM of the controller 100 when the controller 100 controls the current value or voltage value of the needle drive motor 155 based on the data read in step S2.

In the table, e.g., a data table, referenced by the controller 100, the speed of the hollow needle 153 relative to the sealing member 50, the material of the sealing member 50, the thickness of the sealing member 50, the elapsed time since the sealing member 50 is manufactured, and the number of times the hollow needle 153 penetrates the sealing member 50 may be associated with the current value or voltage value of the needle drive motor 155. Further, in the table, the penetrating data and removing data may be associated with individual current values or voltage values of the needle drive motor 155, respectively.

The controller 100 may extract the current value or voltage value corresponding to the data read in step S2 from the table, and may control the needle drive motor 155, so that the needle drive motor 155 may be driven with the current value or voltage value.

The speed of the hollow needle 153 relative to the sealing member 50 may be controlled based on the data stored in the memory 141 of the cartridge 40, e.g., the data for deriving the speed of the hollow needle 153 relative to the sealing member 50 when the hollow needle 153 penetrates the sealing member 50 and when the hollow needle 153 is removed from the sealing member 50. The speed of the hollow needle 153 relative to the sealing member 50 may be set in a proper range in accordance with the state of the sealing member 50 of each of the individual cartridges 40. Thus, problems, such as cracking of the sealing member 50, may be prevented.

The memory 141 of the cartridge 40 may store the individual data, e.g., the penetrating data and removing data, when the hollow needle 153 penetrates the sealing member 50 and when the hollow needle 153 is removed from the sealing member 50. The controller 100 of the printer 1 may control the speed of the hollow needle 153 relative to the sealing member 50 based on the individual data when the hollow needle 153 penetrates the sealing member 50 and when the hollow needle 153 is removed from the sealing member 50. For example, the speed of the hollow needle 153 relative to the sealing member 50 may be decreased at the time of removal as compared with the speed at the time of penetrating, in view of that the sealing member 50 may be deteriorated over time, in particular, at the time of removal as compared with the state at the time of penetrating. Accordingly, cracking of and ink leakage from the sealing member 50 may be reliably prevented from occurring at the time of both penetrating and removal.

In another embodiment, the controller 100 may control the needle drive motor 155, such that the speed of the hollow needle 153 relative to the sealing member 50 may be held constant, instead of holding constant the current value or voltage value of the needle drive motor 155. More specifically, the controller 100 may perform feedback control in which the current value or voltage value of the needle drive motor 155 may be changed based on a signal from an encoder of the needle drive motor 155, so that the speed of the hollow needle 153 relative to the sealing member 50 may be held constant.

For example, the controller 100 may extract the current value or voltage value corresponding to the data read in step S2 from the table and may control the current value or voltage value of the needle drive motor 155 by using the extracted current value or voltage value as a reference value, so that the current value or voltage value of the needle drive motor 155 may be changed by a predetermined amount from the reference value based on a signal from the encoder. Thus, the speed of the hollow needle 153 relative to the sealing member 50 may be held constant, thereby reliably preventing cracking of the sealing member 50 and the like.

The sensor that detects the valve may be a magnetic sensor. In another embodiment, the sensor may be one of a reflection optical sensor, a transmission optical sensor, or a mechanical-switch sensor that detects the presence of an object depending on whether the sensor contacts the object or the like. In still another embodiment, the sensor may be omitted.

The valve body of the valve may be formed of the magnetic substance. In another embodiment, the valve body may be made of an appropriate material in accordance with the type of the sensor. For example, if the sensor is a reflection optical sensor, a valve body may be made of a material other than the magnetic substance, and the peripheral surface of the valve body may be a mirror surface that may reflect light.

Memory may store data for deriving the speed of the needle relative to the sealing member, such as at least one of the speed, data relating to the material of the sealing member, data relating to the thickness of the sealing member in the moving direction of the needle relative to the sealing member, data relating to the elapsed time since the sealing member is manufactured, and data relating to the number of times the needle penetrates the sealing member; or any other data for deriving the speed of the needle relative to the sealing member other than the speed and the above-mentioned data.

The data may relate to each of the above-mentioned elements, e.g., the material of the sealing member, the thickness of the sealing member, the elapsed time after manufacturing, the number of penetrating times, and other elements. In another embodiment, the data may be data that may be used to derive the elements. For example, if the serial number of the cartridge is associated with the material and thickness of the sealing member, the memory may store the serial number.

The number of times the needle penetrates the sealing member may be the number of times the needle has penetrated the sealing member or the number of times the needle is expected to penetrate the sealing member.

The memory of the cartridge may store the table, e.g., the table in which the data for deriving the speed of the needle relative to the sealing member is associated with data that serves as a reference for driving control of moving mechanism. The liquid ejection apparatus may read the table and the data for deriving the speed of the needle relative to the sealing member from the memory of the cartridge and may control the driving of the moving mechanism.

In another embodiment, instead of the memory 141, the ROM of the controller 100 may store data for deriving the speed of the hollow needle 153 relative to the sealing member 50, when the hollow needle 153 penetrates the sealing member 50 and when the hollow needle 153 is removed from the sealing member 50.

The moving mechanism may be configured to move at least one of the needle and the liquid cartridge. For example, the hollow needle 153 may be moved by the needle drive motor 155. In another embodiment, the hollow needle 153 may be fixed, and the cartridge 40 may be moved. In this case, driving of a motor or the like that moves the cartridge may be controlled based on the data stored in the memory of the cartridge.

A liquid stored in a liquid storing portion may be an ink. In another embodiment, the liquid stored liquid storing portion may be an image-quality improvement liquid for improving the quality of an image formed on a recording medium or a cleaning liquid for cleaning the conveying belt.

The liquid ejection apparatus may be one of a line liquid ejection apparatus and a serial liquid ejection apparatus. Also, the liquid ejection apparatus may be a printer. In another embodiment, the liquid ejection apparatus may be a copier.

While the invention has been described in connection with various exemplary structures and illustrative embodiments, it will be understood by those skilled in the art that other variations and modifications of the structures, configurations, and embodiments described above may be made without departing from the scope of the invention. For example, this application may comprise many possible combinations of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid ejection apparatus, to which a liquid cartridge is detachably attached, the liquid cartridge comprising:

a liquid storing portion configured to store liquid;

a communication portion having an opening, which communicates an interior of the liquid storing portion with an exterior of the liquid storing portion; and a sealing member configured to seal the opening of the communication portion, the liquid ejection apparatus comprising:

a liquid ejection head configured to eject liquid;

a hollow needle configured to communicate with the liquid ejection head; and a moving mechanism configured to move at least one of the hollow needle and the liquid cartridge, such that the hollow needle penetrates the sealing member of the liquid cartridge, wherein the liquid cartridge further comprises a particular memory configured to store particular data for determining a speed of the hollow needle relative to the sealing member when the moving mechanism moves the at least one of the hollow needle and the liquid cartridge to penetrate the sealing member of the liquid cartridge with the hollow needle, wherein the liquid ejection apparatus further comprises:

a reader configured to read the particular data stored in the particular memory; and a controller configured to control a speed of the hollow needle relative to the sealing member when the moving mechanism moves the at least one of the hollow needle and the liquid cartridge to penetrate the sealing member of the liquid cartridge with the hollow needle based on the particular data read by the reader, wherein the particular data comprises data relating to a material of the sealing member of the liquid cartridge.

2. The liquid ejection apparatus according to claim 1, further comprising a further memory configured to store a table in which the particular data is associated with speed data relating to a speed of the needle relative to the sealing member, wherein the controller is configured to control a speed of the needle relative to the sealing member based on the particular data read by the reader and the table stored in the further memory.

3. The liquid ejection apparatus according to claim 1, wherein the moving mechanism comprises a motor, and wherein the controller is configured to control one of a current value and a voltage value of the motor.

4. The liquid ejection apparatus according to claim 1, wherein the controller is configured to control a speed of the needle relative to the sealing member to maintain constant.

5. The liquid ejection apparatus according to claim 1, wherein the moving mechanism is further configured to move the at least one of the needle and the liquid cartridge, such that the needle penetrating the sealing member of the cartridge withdraws from the sealing member of the liquid cartridge, wherein the particular memory of the liquid cartridge is further configured to store further data for determining a speed of the needle relative to the sealing member when the moving mechanism moves the at least one of the needle and the liquid cartridge to withdraw the needle from the sealing member of the liquid cartridge, wherein the reader is further configured to read the further data stored in the particular memory, wherein the controller is further configured to control a speed of the needle relative to the sealing member when the moving mechanism moves the at least one of the needle and the liquid cartridge to withdraw the needle from the sealing member of the liquid cartridge based on the further data read by the reader.

6. The liquid ejection apparatus according to claim 1, wherein the particular data comprises data relating to a number of times the sealing member of the liquid cartridge has been penetrated.

7. A liquid ejection apparatus, to which a liquid cartridge is detachably attached, the liquid cartridge comprising:

a liquid storing portion configured to store liquid;

a communication portion having an opening, which communicates an interior of the liquid storing portion with an exterior of the liquid storing portion; and a sealing member configured to seal the opening of the communication portion, the liquid ejection apparatus comprising:

a liquid ejection head configured to eject liquid;

a hollow needle configured to communicate with the liquid ejection head; and a moving mechanism configured to move at least one of the hollow needle and the liquid cartridge, such that the hollow needle penetrates the sealing member of the liquid cartridge, wherein the liquid cartridge further comprises a particular memory configured to store particular data for determining a speed of the hollow needle relative to the sealing member when the moving mechanism moves the at least one of the hollow needle and the liquid cartridge to penetrate the sealing member of the liquid cartridge with the hollow needle, wherein the liquid ejection apparatus further comprises:

a reader configured to read the particular data stored in the particular memory; and a controller configured to control a speed of the hollow needle relative to the sealing member when the moving mechanism moves the at least one of the hollow needle and the liquid cartridge to penetrate the sealing member of the liquid cartridge with the hollow needle based on the particular data read by the reader, wherein the particular data comprises data relating to a thickness of the sealing member in a direction in which the sealing member is penetrated.

8. A liquid ejection apparatus, to which a liquid cartridge is detachably attached, the liquid cartridge comprising:

a liquid storing portion configured to store liquid;

a communication portion having an opening, which communicates an interior of the liquid storing portion with an exterior of the liquid storing portion; and a sealing member configured to seal the opening of the communication portion, the liquid ejection apparatus comprising:

a liquid ejection head configured to eject liquid;

a hollow needle configured to communicate with the liquid ejection head; and a moving mechanism configured to move at least one of the hollow needle and the liquid cartridge, such that the hollow needle penetrates the sealing member of the liquid cartridge, wherein the liquid cartridge further comprises a particular memory configured to store particular data for determining a speed of the hollow needle relative to the sealing member when the moving mechanism moves the at least one of the hollow needle and the liquid cartridge to penetrate the sealing member of the liquid cartridge with the hollow needle, wherein the liquid ejection apparatus further comprises:

a reader configured to read the particular data stored in the particular memory; and a controller configured to control a speed of the hollow needle relative to the sealing member when the moving mechanism moves the at least one of the hollow needle and the liquid cartridge to penetrate the sealing member of the liquid cartridge with the hollow needle based on the particular data read by the reader, wherein the particular data comprises data relating to a time elapsed since the sealing member of the liquid cartridge is manufactured.

9. A liquid ejection apparatus, to which a liquid cartridge is detachably attached, the liquid cartridge comprising:

a liquid storing portion configured to store liquid;

a communication portion having an opening, which communicates an interior of the liquid storing portion with an exterior of the liquid storing portion; and a sealing member configured to seal the opening of the communication portion, the liquid ejection apparatus comprising:

a liquid ejection head configured to eject liquid;

a hollow needle configured to communicate with the liquid ejection head; and a moving mechanism configured to move at least one of the hollow needle and the liquid cartridge, such that the hollow needle selectively penetrates and withdraws from the sealing member of the liquid cartridge, wherein the liquid cartridge further comprises a particular memory configured to store further data for determining a speed of the hollow needle relative to the sealing member when the moving mechanism moves the at least one of the hollow needle and the liquid cartridge to withdraw the hollow needle from the sealing member of the liquid cartridge, wherein the liquid ejection apparatus further comprises:

a reader configured to read the further data stored in the particular memory; and a controller configured to control a speed of the hollow needle relative to the sealing member when the moving mechanism moves the at least one of the hollow needle and the liquid cartridge to withdraw the hollow needle from the sealing member of the liquid cartridge based on the further data read by the reader, wherein the particular data comprises data relating to a material of the sealing member of the liquid cartridge.

10. A liquid ejection apparatus, to which a liquid cartridge is detachably attached, the liquid cartridge comprising:

a liquid storing portion configured to store liquid;

a communication portion having an opening, which communicates an interior of the liquid storing portion with an exterior of the liquid storing portion; and a sealing member configured to seal the opening of the communication portion, the liquid ejection apparatus comprising:

a liquid ejection head configured to eject liquid;

a hollow needle configured to communicate with the liquid ejection head;

a moving mechanism configured to move at least one of the hollow needle and the liquid cartridge, such that the hollow needle penetrates the sealing member of the liquid cartridge;

a particular memory configured to store particular data for determining a speed of the hollow needle relative to the sealing member when the moving mechanism moves the at least one of the hollow needle and the liquid cartridge to penetrate the sealing member of the liquid cartridge with the hollow needle;

a reader configured to read the particular data stored in the particular memory; and a controller configured to control a speed of the hollow needle relative to the sealing member when the moving mechanism moves the at least one of the hollow needle and the liquid cartridge to penetrate the sealing member of the liquid cartridge with the hollow needle based on the particular data read by the reader, wherein the particular data comprises data relating to a material of the sealing member of the liquid cartridge.

11. A liquid cartridge comprising:

a liquid storing portion configured to store liquid;

a communication portion having an opening, which communicates an interior of the liquid storing portion with an exterior of the liquid storing portion;

a sealing member configured to seal the opening of the communication portion and to be selectively penetrated and closed; and a particular memory configured to store at least one of particular data for determining a speed at which the sealing member is penetrated and further data for determining a speed at which the sealing member is closed, wherein the particular data comprises data relating to a material of the sealing member of the liquid cartridge.

12. The liquid cartridge according to claim 11, wherein the particular data comprises data relating to a number of times the sealing member of the liquid cartridge has been penetrated.

13. A liquid cartridge comprising:

a liquid storing portion configured to store liquid;

a communication portion having an opening, which communicates an interior of the liquid storing portion with an exterior of the liquid storing portion;

a sealing member configured to seal the opening of the communication portion and to be selectively penetrated and closed; and a particular memory configured to store at least one of particular data for determining a speed at which the sealing member is penetrated and further data for determining a speed at which the sealing member is closed, wherein the particular data comprises data relating to a thickness of the sealing member in a direction in which the sealing member is penetrated.

14. A liquid cartridge comprising:

a liquid storing portion configured to store liquid;

a communication portion having an opening, which communicates an interior of the liquid storing portion with an exterior of the liquid storing portion;

a sealing member configured to seal the opening of the communication portion and to be selectively penetrated and closed; and a particular memory configured to store at least one of particular data for determining a speed at which the sealing member is penetrated and further data for determining a speed at which the sealing member is closed, wherein the particular data comprises data relating to a time elapsed since the sealing member of the liquid cartridge is manufactured.

* * * * *